United States Patent [19]

Lindquist

[11] Patent Number: 4,623,422

[45] Date of Patent: Nov. 18, 1986

[54] FABRIC FUSING MACHINE

[75] Inventor: Carl E. Lindquist, Lakeville, Pa.

[73] Assignee: M.A.C. Textile Machine Co., Inc., Moscow, Pa.

[21] Appl. No.: 706,398

[22] Filed: Feb. 27, 1985

Related U.S. Application Data

[63] Continuation-in-part of Ser. No. 611,718, May 18, 1984, abandoned.

[51] Int. Cl.[4] ..... B30B 5/04; B30B 15/34

[52] U.S. Cl. ..... 156/583.5; 100/93 P; 100/93 RP; 100/151; 100/168; 156/555; 425/364 R; 425/367

[58] Field of Search ..... 156/555, 583.5, 582; 100/93 P, 93 RP, 151, 210, 168; 425/364 R, 371, 367

[56] References Cited

U.S. PATENT DOCUMENTS

| | | | |
|---|---|---|---|
| 2,746,401 | 5/1956 | Archer | 425/364 R |
| 3,223,027 | 12/1965 | Soda et al. | 100/93 RP |
| 3,712,843 | 1/1973 | Gartaganis et al. | 156/583.5 |
| 3,759,646 | 9/1973 | Massagli et al. | 425/364 R |
| 4,100,773 | 7/1978 | Repetto | 100/151 |
| 4,170,511 | 10/1979 | Milne | 100/93 RP |
| 4,259,143 | 3/1981 | Giulie et al. | 100/93 RP |

*Primary Examiner*—Michael Wityshyn

*Attorney, Agent, or Firm*—Kane, Dalsimer, Kane, Sullivan and Kurucz

[57] ABSTRACT

A fabric fusing device is described having a heat box and a conveyor assembly with a continuous belt. The conveyor assembly is floating above the belt at a preselected distance therefrom and may be pivoted from a horizontal, essentially operating position and a vertical position for maintenance. The belt is supported by rollers, one of which is adjustable for rightening the belt and to compensate for variations in the belt's longitudinal dimensions.

3 Claims, 6 Drawing Figures

FABRIC FUSING MACHINE

This is a continuation-in-part application to U.S. patent application Ser. No. 611,718, filed May 18, 1984, now abandoned.

BACKGROUND OF THE INVENTION a. Field of the Invention

This invention pertains to heat treatment devices for fabrics and more particularly, to an apparatus for fusing a lining to a fabric for the production of collars, cuffs, rolled goods, etc.

b. Description of the Prior Art

Typically, fusing machines employ a continuous belt conveyor which feeds a continuous fabric and a lining passed a fusing station. The essential components of belt conveyors include a frame, a bed, a belt, end rollers, a belt adjustment means, and a power unit. During operation the continuous belt is in constant motion, however, it must be maintained in a very clean condition in order to avoid damage to, or dirtying of, the working material. In addition, the belt, which is generally composed of a flexible resinous material, must be maintained in a properly functioning condition, a particular concern in application to heat treatment processes.

The process of fusing is employed in clothing manufacture to add a lining material to a selected portion of a garment. A gluing substance is applied to a surface of the lining material to produce a fusible lining. A fabric is then placed in contact with the glued surface of the fusible lining. The lining and fabric then undergo a heat treatment process to fuse or bond the lining to the fabric.

Problems have arisen in maintaining the belts of present belt conveying fabric heat treatment devices. A continuous belt extends from outside the heat bed to a location within the heat bed where it feeds the work material into the bed. Consequently, access to the belt for cleaning and maintenance has proven difficult. In prior art fusing equipment access to the continuous belt for proper cleaning and maintenance has necessitated the use of numerous tools and taken much more time. Experience has shown that many hours are often required to change a continuous conveyor belt.

In prior art fabric heat treatment devices, the heating means have commonly been exposed to ambient air in order to enable passing of the belt therethrough. Problems have arisen with these heaters in that a cooling of the ambient air, such as by a draft of air from the opening of a door, often cools the machine down to a temperature at which proper heat fusing does not occur.

A further limitation of prior art devices has been that the heating means generally comprises a single heater which runs horizontal to, and the full length of, the conveyor. Consequently only a single heating temperature is available for fabric heat treatment. In addition, the apparatus may operate only at full heating capacity and is incapable of partial shutdown to save energy for a small amount of work.

Yet another limitation of the prior art devices has been that the conveyor belt was positioned adjacent to the heating element so that, in operation, the heating element was rubbing the conveyor belt. As a result within a very short time the belt deteriorated because of the friction and heat resulting from contact with the heating element.

SUMMARY OF THE INVENTION

The present invention provides an apparatus for fusing a fusible material to a fabric which overcomes the aforenoted problems in the fabric treatment art. To this end, the present invention includes a treatment apparatus having a heat box assembly and a conveyor belt assembly, the treatment apparatus being mounted on a frame, a worktable and a control panel also being mounted on the frame.

In order to facilitate cleaning, maintenance and replacement of the conveyor belt, the present invention provides a hinged coupling of the conveying apparatus to the heat box assembly located therebelow. Thus, the conveyor may be hingedly rotated to a substantially vertical position which allows ease of maintenance such as replacement of the conveyor belt. In addition, access to all parts of the conveyor apparatus is available when the conveyor is in the "up" position allowing a complete, expeditious cleaning.

The heat box assembly is a closed unit having heating elements therewithin and a heat platen at an upper surface thereof. The work materials do not pass into the heat box assembly, but instead, they pass along an outer surface of the heat platen so that heat is transferred from the heat platen to the work materials. In addition side supports are provided along the sides of the treatment apparatus in order to encase the work material during heating. Thus an enclosed heating system is provided which attains reliable fusing temperatures regardless of the ambient conditions. Product uniformity and product quality are thereby improved. The present closed heating system is designed so that it could be operated in a windstorm with no effect on the quality of the fusing.

Another novel feature of the present heating system is that it contains two separate heating compartments. The staged heating system enables one side of the heater to be operated independently of the other side. A separator is provided between the heater sections. Greater versatility is thus added for daily operation of the heater. One side of the heater may be completely shut down to conserve energy while processing a small amount of work, resulting in a 50 percent energy savings, or the sides of the machine may be operated at two different temperatures at the same time. Since not all fusibles fuse at the same temperature this feature renders the present fusing machine more efficient for processing certain jobs. In addition, the machine may operate at a lower temperature thereby attaining energy efficiency and longer machine line.

Advantageously, while a minimum distance is maintained between the conveyor belt and the heat platten, the conveyor assembly is allowed to float above the platten to permit various fabrics to be used in the machine. In addition, at least at one end of the conveyor assembly means are provided for tensioning the belt and for compensating for longitudinal dimensional variations in the belt.

BRIEF DESCRIPTION OF THE DRAWINGS

FIG. 6 shows mounting details of the end support roller.

DETAILED DESCRIPTION OF THE PREFERRED EMBODIMENT

Figure 1:
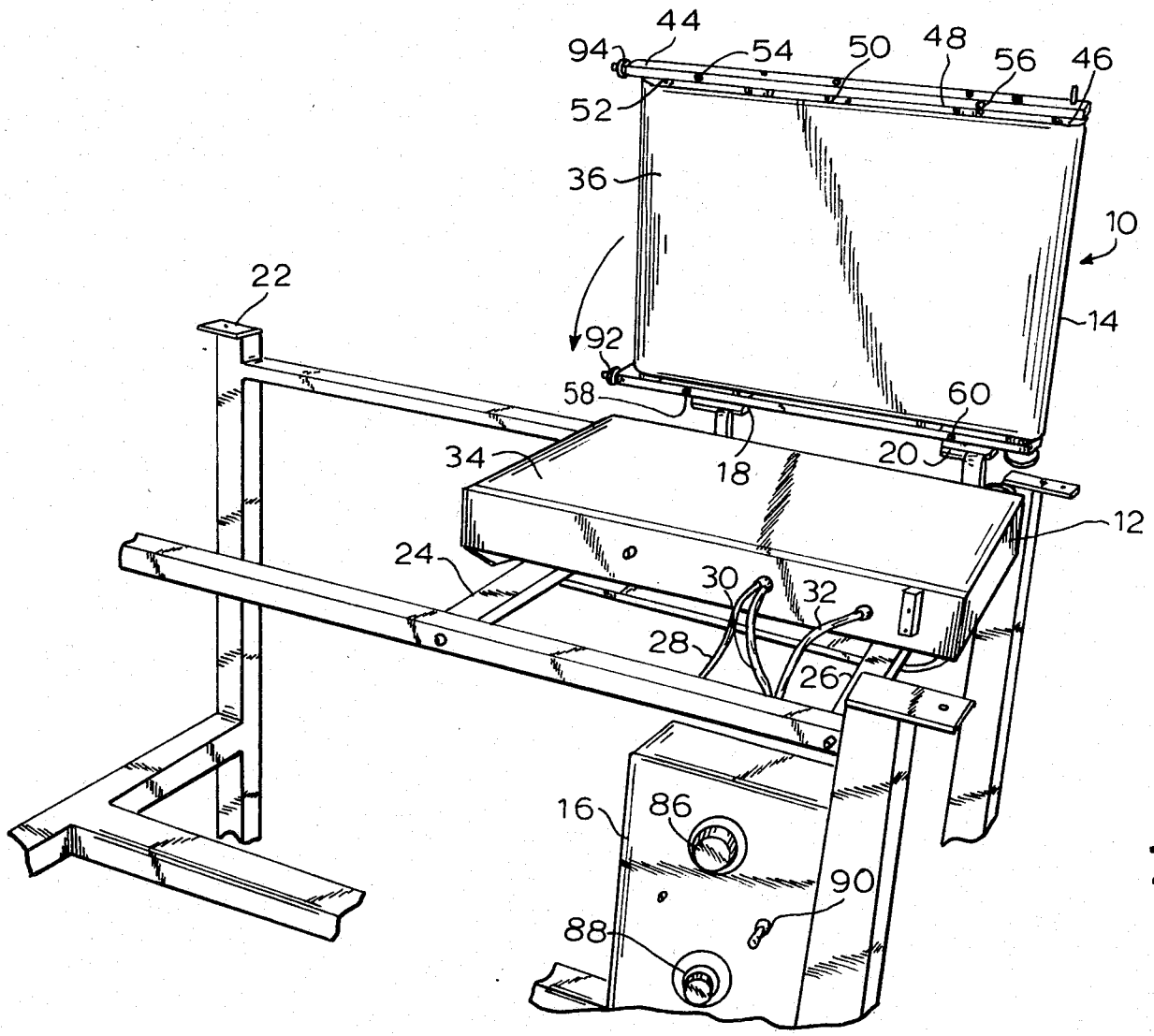
FIG. 1 is a perspective view of the present fusing machine.
Figure 3:
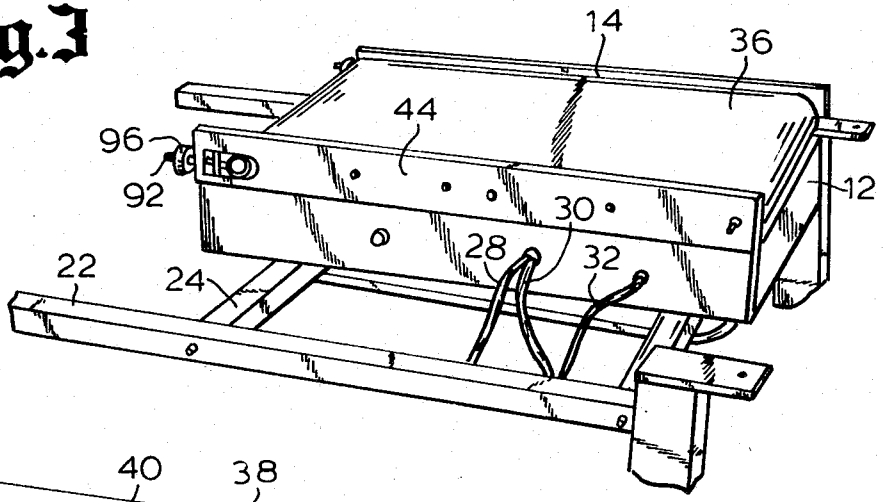
FIG. 3 is a perspective view of the present fusing machine mounted on a frame and having the conveyor assembly in a horizontal or operational position.
Figure 2:
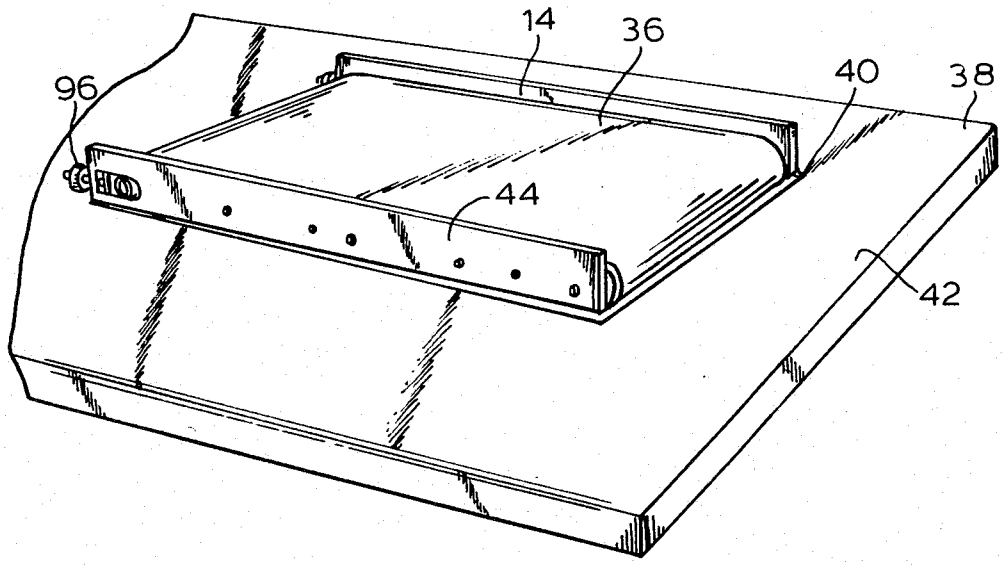
FIG. 2 is a perspective view of the present fusing machine mounted with a worktable.
Figures 4, 5:
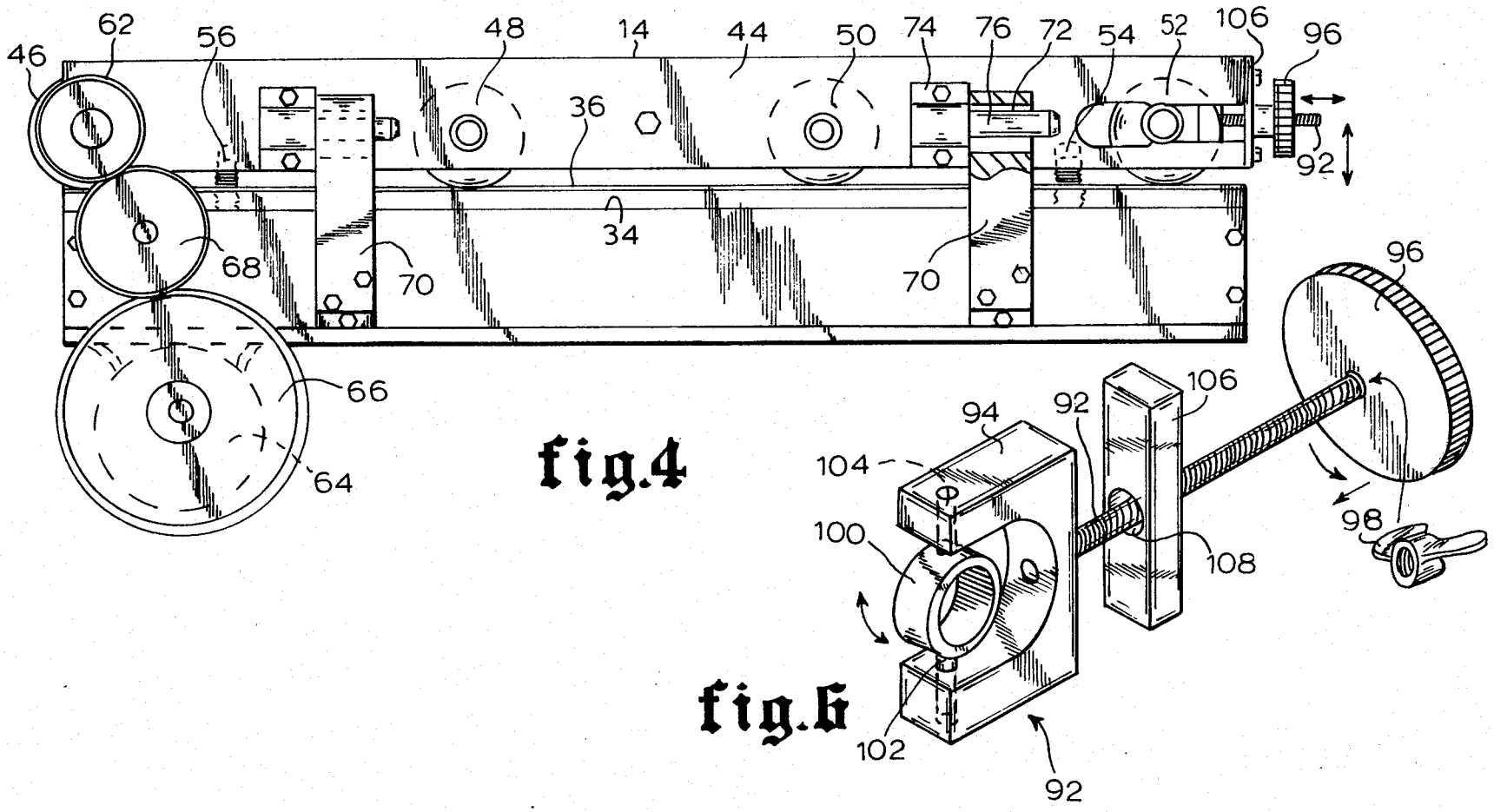
FIG. 4 is a side view of the present fusing machine.
FIG. 5 is a front sectional view of the heat box assembly.
Figure 5:
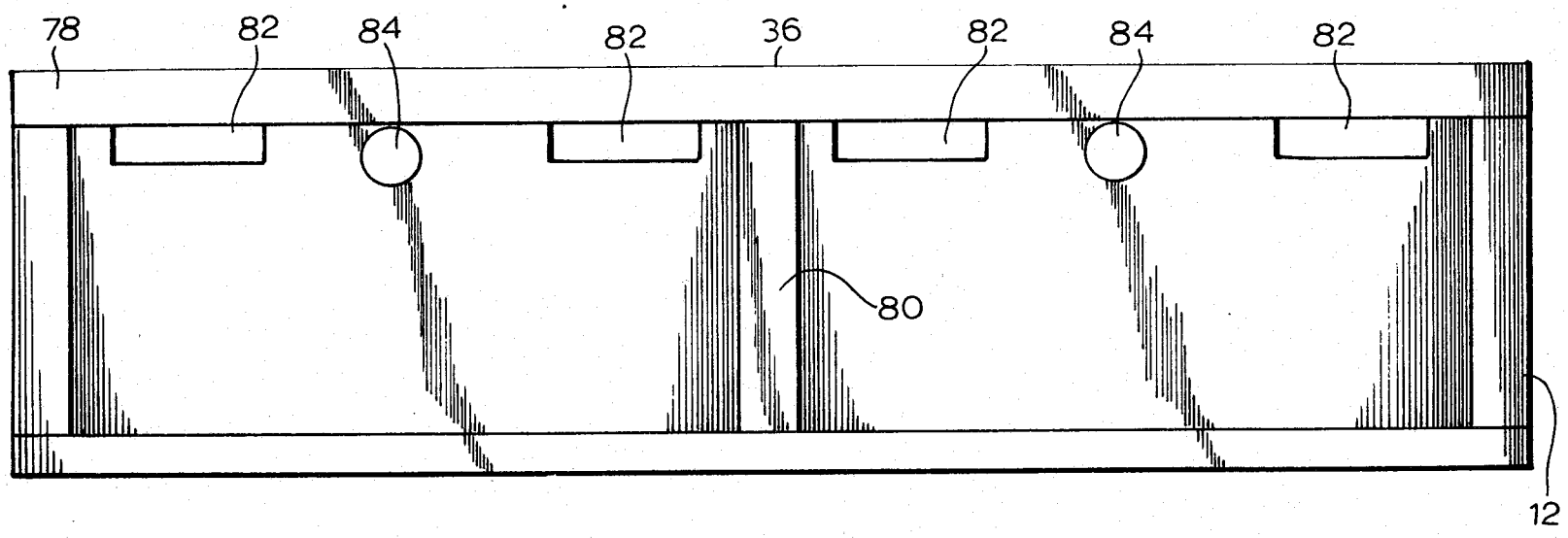

A fabric fusing machine 10 constructed in accordance with the present invention is illustrated in FIG. 1. It comprises a heating box 12, a conveyor assembly 14 and a control box 16. The conveyor box is pivoted by two hinges 18 and 20 along a horizontal axis so that it may be closed unto the heat box 12 as shown in FIG. 3. The fabric fusing device is disposed on a frame 22, having two transversal members 24 and 26, which support the heating box and the conveyor assembly. The control box 16 is disposed below the heating box, as shown, and is connected thereto by wires 28, 30 and 32. The heating box is provided with a top contacting surface or platten 34, which shall be described later and which cooperates with a belt 36 of conveyor assembly 14 to heat a fabric and a fabric lining. As shown in FIG. 2, a table 38 is mounted on frame 22. The table is provided with a generally rectangular cavity 40 so that it surrounds the heating box and the conveyor assembly. Table 38 is arranged and positioned so that its top surface 42 is substantially coplanar with surface 34 of the heating box so that in effect the heating box and the top surface 42 form a continuous work surface. As can be seen in FIGS. 1 and 4, the conveyor assembly comprises a generally rectangular frame 44 in which there are provided a drive roller 46, intermediate rollers 48 and 50 and an end roller 52. The conveyor assembly 14 is also provided with four adjustable spacers 54, 56, 58 and 60. As can be seen in FIG. 4, the purpose of these spacers is to maintain conveyor assembly up above a certain minimum distance above top surface 34 of the heating box 14, so that belt 36 does not come into contact with surface 34. As best seen in FIG. 4, drive roller 46 is provided at one end with gear 62. An electric motor 64 is mounted under the heating box and it has a gear 66. Another gear 68 is mounted on heat box 12 which couples gear 66 to gear 62. Therefore, as motor 64 rotates, its motion is transmitted by gears 66, 68 and 62 to roller 46. Belt 36 is mounted on rollers 46, 48, 50 and 52. Intermediate rollers 48 and 50 are provided to support the belt and provide necessary pressure on the fabric and lining during the heating process. As shown in FIG. 4, hinges 18 and 20 comprise a relatively straight member 70 mounted to and extending above the heating box and having at its upper end, a slot 72. A bracket 74 is provided on frame 44 of the conveyor assembly and it hold on pin 76. Pin 76 extends through slot 72 of member 70. As shown in FIG. 4, pin 76 has a diameter which is smaller than the vertical dimension of slot 72 allowing assembly 14 to float above heating box 12 as required by the thickness of the fabric and fabric liner disposed therebetween. Of course, pin 76 is rotatable within slot 72, thereby enabling conveyor assembly 14 to pivot around the horizontal axis as described above.

A side sectional view of the heating box 12 is shown in FIG. 5. It comprises a generally rectangular box, having a top plate 78. Box 30 is partitioned into two sections by a vertical wall 80 and within each wall there are a plurality of heating elements 82 and sensors 84. These heating elements and sensors are mounted to plate 78. Heating elements 82 are provided to heat plate 78 and while sensors 84 are used to monitor the plate's temperature. The heating elements are preferably electrical heating elements and they may comprise an electrical resistance enclosed in an oil bath. Such elements are well known in the art and need not be described any further.

Motor 64, heating elements 82 and heat sensors 84 are connected by wires 28, 30 and 32 (see FIG. 1) to control box 16. Control box 16 has various controls such as reostat 86 and speed controller 88 provided to control the temperature of heating surface 34 and the speed of motor 64, respectively. Control box 16 is also provided with an ON/OFF switch 90 as shown.

Belt 36 is made of a relatively flexible material, such as a composite rubber or a synthetic equivalent. It is well known that such materials frequently lose their dimensional stability, particularly after a prolonged use. In order to tighten the belt and to compensate for dimensional variations of the belt, the position of end roller 52 is adjustable by two, substantially identical support elements 92 and 94. Details of these support elements are shown in FIG. 6. Each comprises a generally C-shaped member 94, which is attached to one end of a screw 96. Mounted on screw 96 is a winged nut 98. Attached to C-shaped element 94 is a ring 100 which is pivotably coupled by pins 102 and 104, which permit ring 100 to pivot around a vertical axis with respect to C-shaped element 94. Ring 100 is adapted to engage one end of roller 52. As shown in FIG. 6, support member 92 is used to mount roller 52 to an end wall 106 of structure 44. Screw 96 extends through a hole 108 provided in end wall 106. After the belt has been mounted on roller 52, wing nuts 98 of each support 92 and 94 are individually tightened as desired to compensate for dimensional variations in the belt. Because ring 100 is able to rotate around the vertical axis in respect to end wall 106, obviously roller 52 does not have to be positioned in parallel with the other roller. As shown in FIG. 6, hole 108 is slightly larger than nut 96 permitting roller 52 to be shifted vertically with respect to structure 44. Thus in effect, end roller 52 has three degrees of freedom: it may be moved towards or away from end roller 106, it may shifted up and down in parallel with end roller 106, or it may be pivoted around the vertical axis.

The operation of the device is obvious from the above description. Initially, the fabric fusing device is in position as indicated in FIG. 1, i.e. with the conveyor assembly in the vertical position. One end of a fabric roll is placed on heating surface 34 after which the conveyor assembly is pivoted to its horizontal position forcing gear 62 to engage gear 68. Next, motor 64 is turned on and operated with a preselected speed in accordance with control 88. The temperature of surface 34 is preset by control 86 as required. Alternatively, the two sections of surface 34 may be set at different temperatures by heater 82 and heat sensors 84 as required. As motor 64 turns it rotates belt 36 which forces the fabric and liner across the surface 34 to fuse the liner to the fabric. At all times the belt 36 is kept away from the surface 34 by spacers 54, 56, 58 and 60. In addition, conveyor assembly 14 is in effect allowed to float above the heating box by the arrangement of pin 76 and the hole 72 as described above. After the fabric fusing device has been operated for a while, the belt may lose its shape and it may be expeditiously tightened by turning nut 98. If the belt is seriously deteriorated, the conveyor assembly is pivoted to its vertical position of FIG. 1 and then the belt is replaced.

Obviously, numerous modifications may be made to the subject invention without departing from its scope as defined in the appended claims.

I claim:

1. A fabric fusing device comprising:

a heating box having a flat surface;

a conveyor assembly disposed above the heating box and having a continuous belt structured and arranged to rotate at a predetermined minimum distance above said flat surface;

means for driving said belt; and hinging means pivotably connecting said conveyor assembly to said heating box;

said conveyor assembly comprising a rectangular frame; a drive roller for driving said belt; an end roller with two opposed pins; and two independent mounting means for mounting the pins; each having a ring for engaging one of the pins, a ring retaining means for pivotably holding said rings, said rings being rotatable around a vertical axis; and adjusting means for adjustably securing said ring retaining means to said frame.

2. The device of claim 1 further comprising means for allowing said conveyor assembly to float above said flat surface.

3. The device of claim 1 wherein said adjusting means comprises a screw secured to said ring retaining means and a nut rotatable on said screw.

* * * * *